US007455261B2

(12) United States Patent
Tang

(10) Patent No.: US 7,455,261 B2
(45) Date of Patent: Nov. 25, 2008

(54) TIGHTENING MECHANISM FOR ADJUSTABLY SETTING A TAPE HOLDER TO AN IMMOVABLE STATE ON A TAPE DISPENSER

(75) Inventor: Po Chiang Tang, Taipei (TW)

(73) Assignee: Prudential Co., Ltd., Taipei (TW)

( * ) Notice: Subject to any disclaimer, the term of this patent is extended or adjusted under 35 U.S.C. 154(b) by 365 days.

(21) Appl. No.: 11/369,829

(22) Filed: Mar. 8, 2006

(65) Prior Publication Data

US 2007/0210205 A1 Sep. 13, 2007

(51) Int. Cl.
*B65H 75/24* (2006.01)
*B44C 7/00* (2006.01)

(52) U.S. Cl. ..... 242/571.8; 156/577

(58) Field of Classification Search ..... 242/571.8, 242/588.2, 597.1; 156/577
See application file for complete search history.

(56) References Cited

U.S. PATENT DOCUMENTS 4,880,152 A * 11/1989 Trankle ..... 224/162
5,110,401 A * 5/1992 Huang ..... 156/527
5,776,301 A * 7/1998 Huang ..... 156/577

* cited by examiner

*Primary Examiner*—Sang Kim
(74) *Attorney, Agent, or Firm*—Rosenberg, Klein & Lee

(57) ABSTRACT

A tightening mechanism for adjustably setting a tape holder to an immovable state on a tape dispenser includes a tape holder being provided at an axially outer end with a flared round recess, a bushing ring having a bevel wall and being fitted in the flared round recess, and a locating member slightly smaller than the bushing ring for fitly seating in the bushing ring. A turning knob having a spring put thereon is sequentially extended through the locating member and the bushing ring to screw into a fixing bar, on which the tape holder is mounted. When the knob is turned, a tightness of the bushing ring against the flared round recess is progressively changed to thereby adjust the tape holder to different degrees of immobility, allowing the tape dispenser to apply to tapes of different adhesion ability.

1 Claim, 4 Drawing Sheets

TIGHTENING MECHANISM FOR ADJUSTABLY SETTING A TAPE HOLDER TO AN IMMOVABLE STATE ON A TAPE DISPENSER

FIELD OF THE INVENTION

The present invention relates to a tightening mechanism for setting a tape holder to an immovable state on a tape dispenser, and more particularly to a tightening mechanism adapted to adjustably set a tape holder to an immovable state on a tape dispenser, so that the tape dispenser is applicable to tapes of different adhesion ability.

BACKGROUND OF THE INVENTION

FIG. 1 shows a general tape dispenser 1, which includes a tape holder 11 for supporting a tape roll (not shown) thereon, a blade 12 located in front of the tape holder 11, and a roller 13 located below the blade 12. The tape may be pulled from the tape holder 11 to the roller 13 for bonding to something, and then cut by the blade 12 when the bonding is completed. Tapes of different adhesion ability are available. When a tape with relatively high adhesion ability is mounted on the tape dispenser 1 for use, the tape holder 11 must have a high immobility, so that the tape could be successfully pulled out from the tape holder 11 and be cut by the blade 12. For this purpose, there is a tightening mechanism provided on the tape holder 11 of the tape dispenser 1. FIG. 2 is an exploded perspective view of the conventional tightening mechanism for this purpose. As shown, the tape holder 11 of the tape dispenser 1 is provided at a central portion with an axial hole, an outer end of which is formed into an expanded round recess 111 having a straight peripheral wall for a washer 14 and a locating member 15 to fit therein. The tape holder 11 is mounted on a fixing bar 16, and a turning knob 18 having a spring 17 put thereon is sequentially extended through the locating member 15, the washer 14, and the round recess 111 to screw to the fixing bar 16. When the turning knob 18 is turned forward, the washer 14 is forced against the round recess 111 to enhance an immobility of the tape holder 11. In the above-described conventional tightening mechanism, since the force generated by the turning knob 18 is vertically transmitted from the locating member 15 to the washer 14 and the round recess 111, the tightness of the washer 14 against the round recess 111 is not adjustable. Therefore, the conventional tightening mechanism is not ideal for use, and the immobility of the tape holder 11 is not adjustable according to the adhesion ability of the tape being used on the tape dispenser 1.

SUMMARY OF THE INVENTION

A primary object of the present invention is to provide a tightening mechanism for adjustably setting a tape holder to an immovable state on a tape dispenser, so that the tape dispenser is applicable to tapes of different adhesion ability.

To achieve the above and other objects, the tightening mechanism according to the present invention includes a tape holder being provided at an axially outer end with a flared round recess, a bushing ring having a bevel wall and being fitted in the flared round recess, and a centrally holed locating member slightly smaller than the bushing ring for fitly seating in the bushing ring. A turning knob having a spring put thereon is sequentially extended through the locating member and the bushing ring to screw into a fixing bar, on which the tape holder is mounted. When the knob is turned, a tightness of the bushing ring against the flared round recess is changed to thereby adjust the tape holder to a different degree of immobility, allowing the tape dispenser to apply to tapes of different adhesion ability.

Since the bushing ring and the flared round recess are contacted with each other at an annular bevel wall, the tightness of the bushing ring against the flared round recess is progressively adjustable by turning the knob to different extents. Accordingly, the immobility of the tape holder is also adjustable.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
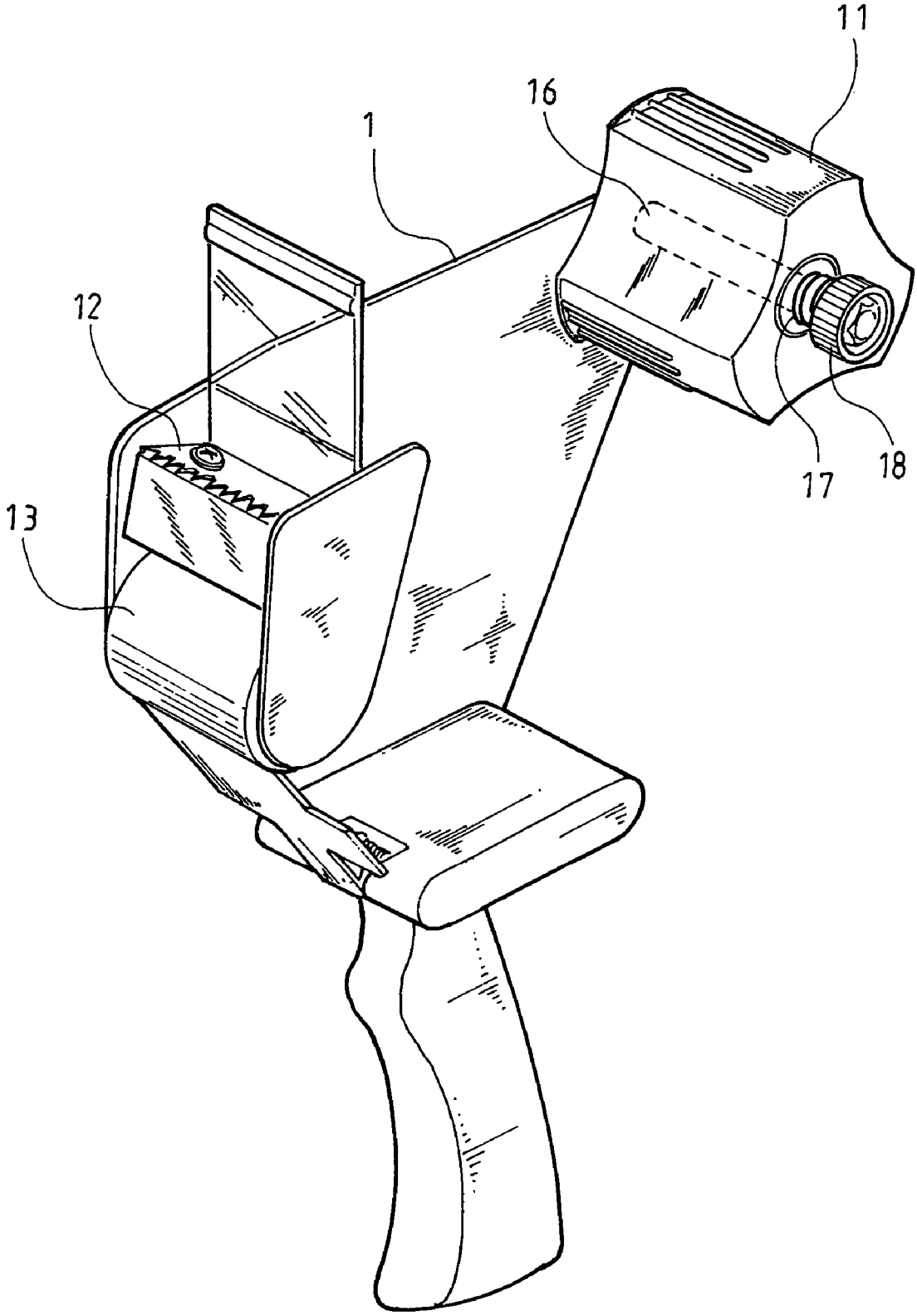
FIG. 1 is a perspective view of a general tape dispenser.
Figure 2:
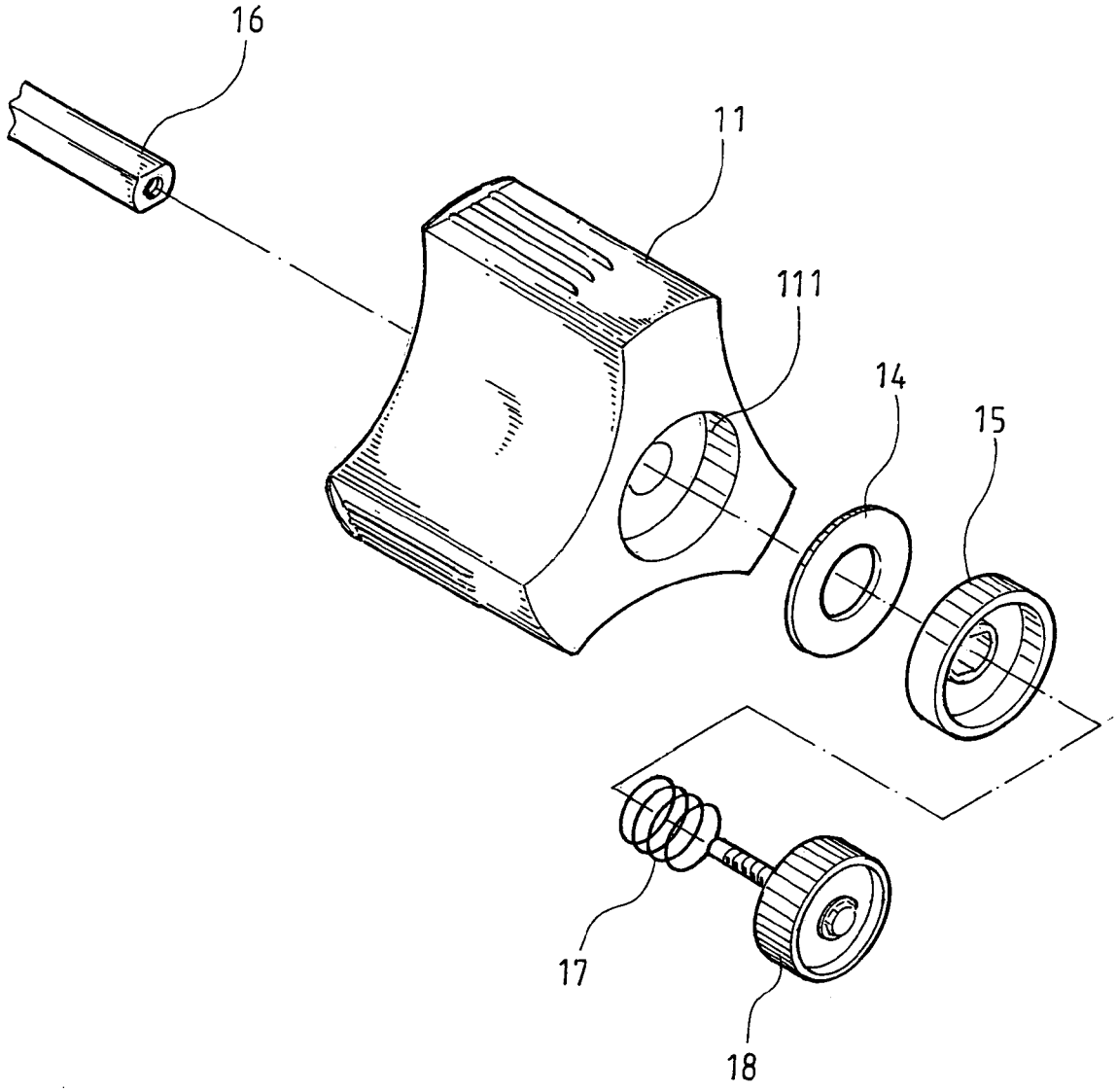
PRIOR ART FIG.2
FIG. 2 is an exploded perspective view of a conventional tightening mechanism for setting a tape holder to an immovable state on the tape dispenser.
Figure 3:
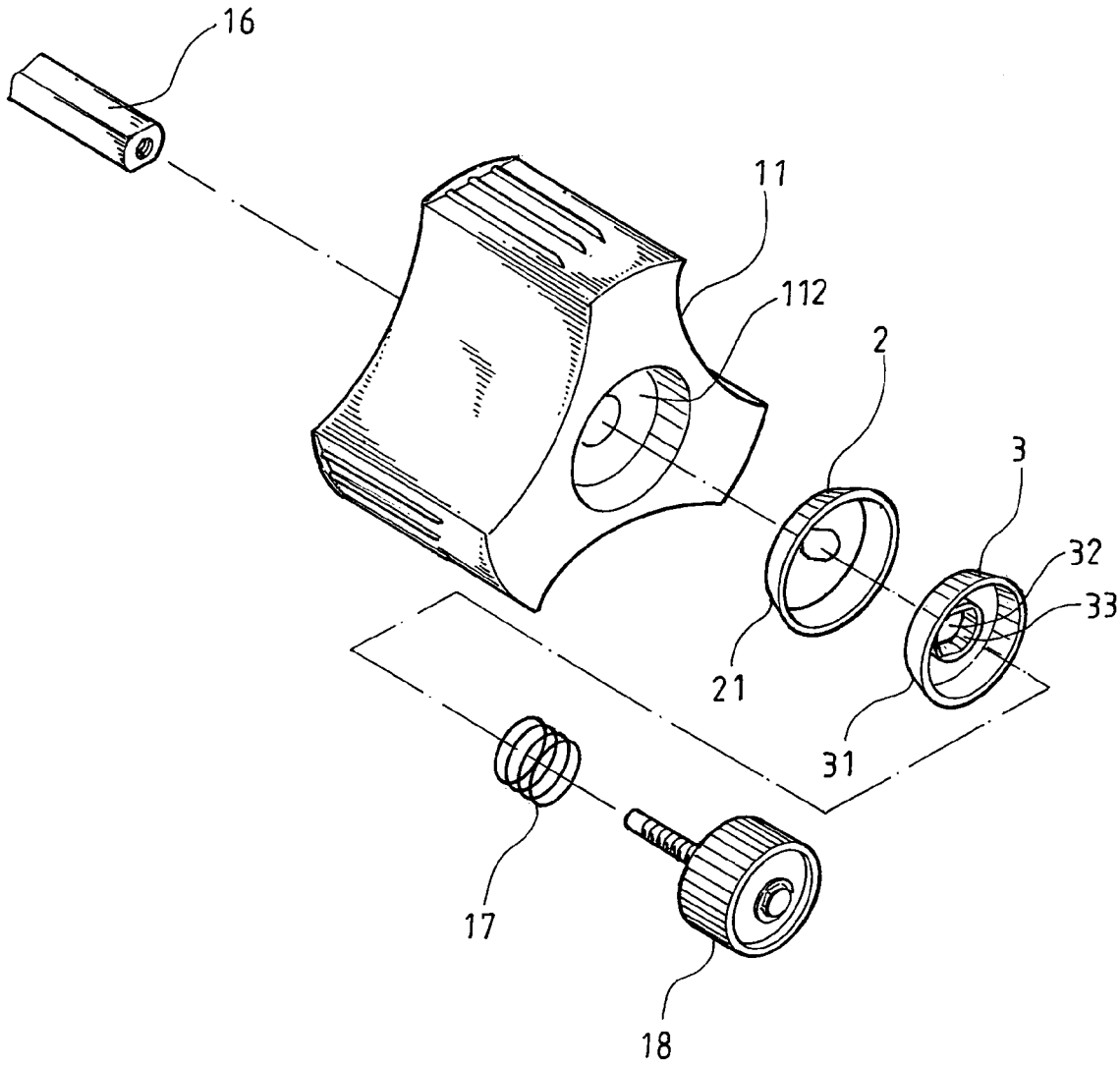
FIG. 3 is an exploded perspective view of a tightening mechanism for adjustably setting a tape holder to an immovable state on a tape dispenser tape holder stop mechanism for tape dispenser according to the present invention.

Please refer to FIGS. 1 and 3 at the same time. The present invention relates to a tightening mechanism for adjustably setting a tape holder 11 to an immovable state on a tape dispenser 1 having a general structure as shown in FIG. 1. In the present invention, the tape holder 11 for the tape dispenser 1 is provided at a central portion with an axial hole, an outer end of which is formed into a flared round recess 112 for a bushing ring 2 and a locating member 3 to fit therein. The bushing ring 2 includes a bevel wall 21. The locating member 3 is slightly smaller than the bushing ring 2, and is provided with a bevel wall 31 similar to the bushing ring 2. A through hole 32 having an axially extended annular flange 33 is formed at a bottom central area of the locating member 3.

A threaded stem of the turning knob 18 of the tape dispenser 1 is sequentially extended through the spring 17, the through hole 32 of the locating member 3, and the bushing ring 2 to screw into the fixing bar 16 on the tape dispenser 1. When the turning knob 18 is turned forward, the spring 17 is compressed to generate an increased force to more tightly push the bushing ring 2 into the flared round recess 112, so that the tape holder 11 is adjusted to an increased immobility. Therefore, when a tape having relatively high adhesion ability is mounted on the tape holder 11 of the tape dispenser 1 for bonding to something, the tape holder 11 could be easily adjusted to an increased immobility via the turning knob 18, so that the tape may still be successfully pulled out from the tape holder 11 for bonding and then cut by the blade 12.

Figure 4:
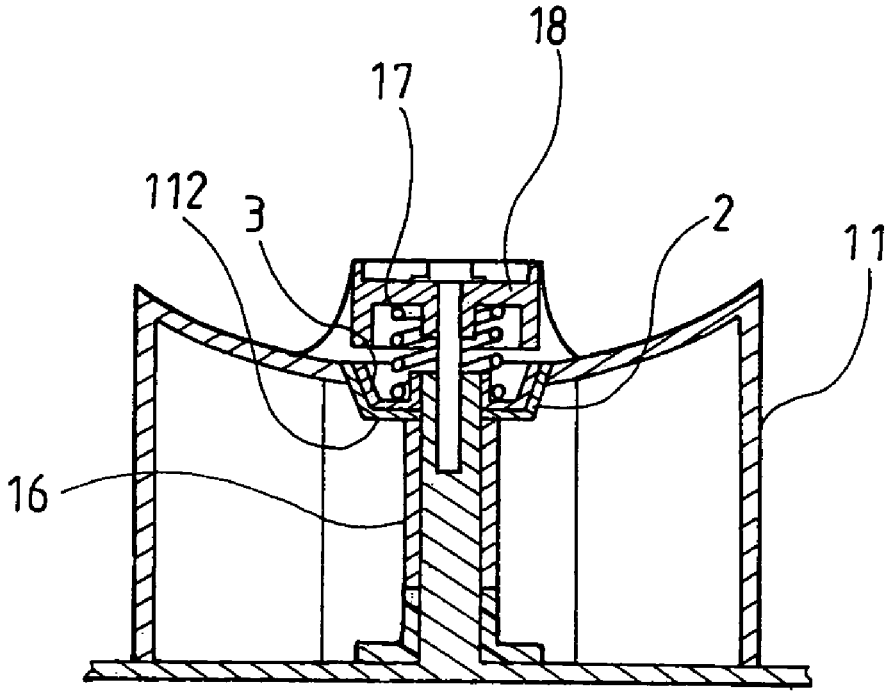
FIG. 4 is an assembled sectional view of the tightening mechanism according to the present invention.

Please refer to FIG. 4 that is an assembled sectional view of the tightening mechanism of the present invention. As shown, the tape holder 11 is provided at an axially outer end with the flared round recess 112, and the bushing ring 2 and the locating member 3 are sequentially fitted in the flared round recess 112. When the turning knob 18 is turned forward, the pressure generated by the spring 17 against the locating member 3 is increased for the bevel wall 21 of the bushing ring 2 to progressively tightly press against the flared round recess 112, so that the tape holder 11 is set to an increased immobility without rotating or skidding due to a force applied thereto by the highly adhesive tape. Thus, the tape holder 11 could be properly adjusted to different degrees of immobility according to the adhesion ability of the tape being used, enabling the tape dispenser 1 to apply to tapes of different adhesion ability.

What is claimed is:

1. A tightening mechanism for adjustably setting a tape holder to an immovable state on a tape dispenser, comprising:

a tape holder being mounted on a fixing bar on the tape dispenser for a tape roll to mount thereon, and provided at an axially outer end with a flared round recess;

a bushing ring having a bevel wall and being fitted in said flared round recess on said tape holder; and a locating member having a size slightly smaller than said bushing ring for fitly seating in said bushing ring, said locating member being provided at a central area with a through hole, and said central through hole having an axially extended annular flange;

whereby when a turning knob having a spring put thereon and being sequentially extended through said locating member, said bushing ring, and said flared round recess to screw into said fixing bar is turned, a tightness of said bushing ring against said flared round recess is progressively changed due to a bevel contact surface between said bushing ring and said flared round recess, and said tape holder is accordingly adjustable to different degrees of immobility on said fixing bar.

* * * * *